US005794745A

United States Patent [19]

Gore

[11] Patent Number: 5,794,745

[45] Date of Patent: Aug. 18, 1998

[54] FINGER GUARD FOR A DOOR OF AN ELEVATOR

[75] Inventor: Nicholas Gore, Hanam, United Kingdom

[73] Assignee: Kleeneze Sealtech Limited, Bristol, United Kingdom

[21] Appl. No.: 616,193

[22] Filed: Mar. 15, 1996

[30] Foreign Application Priority Data

Mar. 16, 1995 [GB] United Kingdom ..... 9505275

[51] Int. Cl.[6] ..... B66B 13/06

[52] U.S. Cl. ..... 187/333; 187/400

[58] Field of Search ..... 187/333–335, 187/400, 324

[56] References Cited

U.S. PATENT DOCUMENTS 5,540,302 7/1996 Nagasawa et al. ..... 187/334 X

FOREIGN PATENT DOCUMENTS 1397377 3/1965 France ..... 187/400
282182 11/1990 Japan ..... 187/334
64879 3/1994 Japan ..... 187/334

*Primary Examiner*—Boris Milef
*Attorney, Agent, or Firm*—Birch, Stewart, Kolasch & Birch, LLP

[57] ABSTRACT

A finger guard for a door of an elevator comprising a brush carrier, which is arranged for attachment to an architrave adjacent the elevator door of the kind, which, for opening and closing, slides sideways in a vertical plane relative to the architrave, and a brush carried by the carrier and disposed to be directed outward from the architrave and into close adjacency with at least one of the elevator doors so as to be angled across a corner region between the architrave and the elevator door whereby to provide a guard against fingers being trapped between the door on the architrave in the corner region.

4 Claims, 1 Drawing Sheet

FINGER GUARD FOR A DOOR OF AN ELEVATOR

FIELD OF THE INVENTION

The present invention relates to protective measures for use with elevators, and in particular with elevators using sliding doors.

DESCRIPTION OF THE BACKGROUND ART

With such elevators the problem exists that the doors slide open or closed with respect to an architrave at the corner of the door opening (usually one on each side) and as the door opens there is risk of fingers being trapped in the corner region between the architrave and the elevator door. The present invention is concerned with this problem.

SUMMARY OF THE INVENTION

Accordingly the invention provides an elevator of the kind having an architrave on at least one side of an opening and doors which slide sideways in a vertical plane relative to said architrave, a finger guard comprising a brush carrier, attached to said architrave adjacent the elevator door and a brush carried by said carrier and disposed to be directed outward from said architrave and into close adjacency with said elevator door so as to be angled across a corner region between the architrave and the elevator door whereby to provide a guard against fingers being trapped between the door and the architrave in said corner region.

The brush should be angled away from the corner so that this keeps the fingers away from this dangerous corner region. It is important, however, in achieving this objective that the guard system itself does not protrude in such a way that items such as goods trollies being moved into and out of the elevator knock the finger guard and cause it to be damaged. Thus, the carrier for the brush should be shallow in depth, so that when attached to the architrave it takes up little space and does not protrude to catch against such objects. In regard to the brush and its contact with the elevator door, the brush should be in close adjacency, which means that it should be either just touching or only about one millimetre spaced from the door. It is also preferred that the end of the brush is cut at an oblique angle to allow it to lie flush with the elevator door. An elevator door is normally smooth and therefore with such a location and disposition there is minimal danger of the door catching the brush and pulling it back into the corner.

Generally the carrier will be a strip extrusion and preferably it should have slotted screw holes to permit attachment to the architrave, the slotting of the screw holes allowing for fine adjustment to achieve the fit of the brush to the elevator door as required.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

An embodiment of the invention will now be described by way of example with reference to the accompanying diagrammatic drawings which are given by way of illustration only, and thus are not limitative of the present invention, and in which.

DETAILED DESCRIPTION OF THE PREFERRED EMBODIMENTS

Figure 1:
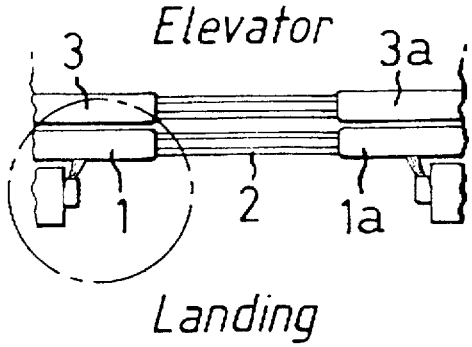
FIG. 1 is a fragmented plan view of a elevator door and architrave.
Figure 2:
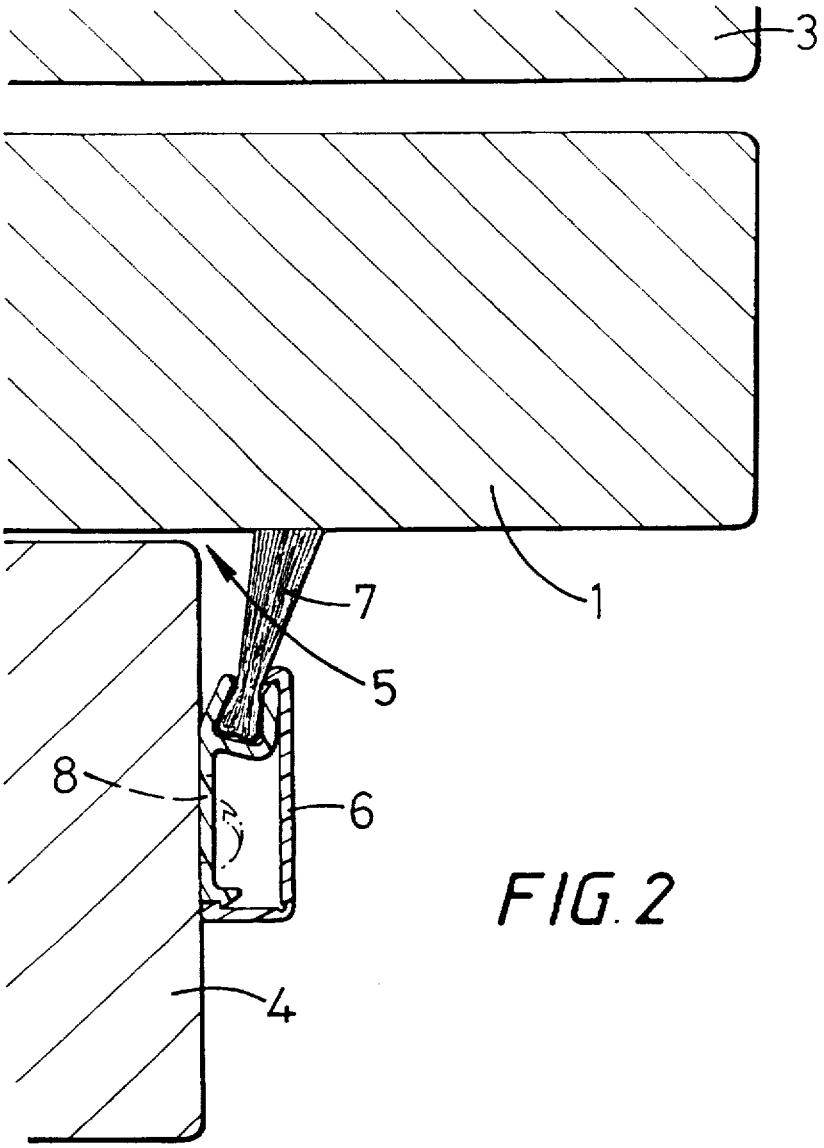
FIG. 2 is an enlargement of a section of the FIG. 1 view.

Referring to FIG. 1, outer elevator doors 1 and 1A slide on runners 2 to meet and close the door while inner doors 3 and 3A similarly close.

The elevator door 1 slides in a vertical plane relative to an architrave 4 and thereby a corner area 5 presents a risk that fingers can be trapped in that region.

To solve this problem of finger entrapment, a brush strip 6 carrier which is a plastics extrusion of shallow depth is attached to the architrave and carries a brush strip 7. The brushes have an oblique angled end profile which lies flush with the edge of the elevator door 1 and thereby provides a guard against finger entrapment in the region 5. As can be seen in the figure, the brush strip is at a shallow angle which keeps the fingers away from the region 5 and will be in close adjacency with the surface of the door 1. That means that the brush is just touching the door 1 or spaced by a small amount, say one millimeter. In order to achieve this particular level of adjacency, the brush strip 6 is attached to the architrave via slotted screw holes 8 which allow for fine adjustment of the location of the brush strip.

As can be seen from the figure, the brush strip carrier 6 is in two parts one of which is screwed to the architrave via the screw holes 8 and carries the brush 7 and the other part is a snap on cover. The snap on cover ensures that no sharp or protruding regions are presented to incoming traffic such as load trollies which might present the risk of the protrusion being caught by the incoming object and being damaged. The whole carrier 6 as can be seen is shallow and the peripheral surface of the carrier and the brush protrudes a minimum amount from the architrave and elevator door.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. In an elevator having an architrave on at least one side of an opening and doors which slide sideways in a vertical plane relative to said architrave, a finger guard comprising a brush carrier, attached to said architrave adjacent at least one of the elevator doors and a brush carried by said carrier and disposed to be directed outward from said architrave and into close adjacency with said at least one elevator door so as to be angled across a corner region between the architrave and the at least one elevator door whereby to provide a guard against fingers being trapped between the at least one door and the architrave in said corner region, an outer end of the brush being cut at an oblique angle to allow the outer end to lie flush with the at least one elevator door.

2. The finger guard in an elevator according to claim 1, in which said carrier is a strip extrusion having slotted screw holes.

3. The finger guard in an elevator according to claim 2, further comprising a snap-on cover for covering said strip extrusion.

4. The finger guard in an elevator according to claim 1, wherein a brush carrier with a brush is attached adjacent each of the elevator doors.

* * * * *